US006415829B1

(12) United States Patent
Chiang

(10) Patent No.: US 6,415,829 B1
(45) Date of Patent: Jul. 9, 2002

(54) WOOD PLANING MACHINE THAT PERMITS MOTOR-DRIVEN HEIGHT ADJUSTMENT OF A CUTTER CARRIAGE

(76) Inventor: Pei-Lieh Chiang, No. 12, Nan-Ping Rd., Nan Dist., Taichung (TW)

( * ) Notice: Subject to any disclaimer, the term of this patent is extended or adjusted under 35 U.S.C. 154(b) by 74 days.

(21) Appl. No.: 09/824,501

(22) Filed: Apr. 2, 2001

Related U.S. Application Data

(63) Continuation-in-part of application No. 09/741,553, filed on Dec. 19, 2000.

(30) Foreign Application Priority Data

Feb. 14, 2001 (TW) ..... 090202228

(51) Int. Cl.[7] ..... B27C 1/00

(52) U.S. Cl. ..... 144/130; 74/22 A; 74/27; 74/89.28; 74/473.14; 144/117.1; 403/343; 403/345

(58) Field of Search ..... 74/22 A, 35, 27, 74/89.28, 89.38, 144, 441, 473.14, 473.23, 372; 144/114.1, 117.1, 129, 130; 409/156, 210, 218; 403/343, 345, 347

(56) References Cited

U.S. PATENT DOCUMENTS 4,456,042 A * 6/1984 Clark et al. ..... 144/129
4,485,859 A * 12/1984 Krogstad et al. ..... 144/114.1 X
5,176,190 A * 1/1993 Miyamoto et al. ..... 144/117.1
5,988,239 A * 11/1999 Chen ..... 144/129
6,089,286 A * 7/2000 Liao ..... 144/117.1

* cited by examiner

*Primary Examiner*—W Donald Bray

(57) ABSTRACT

In a wood planing machine having rotatable screw rods and a cutter carriage with threaded members that engage the screw rods, a gear mounting seat is slidable along a drive shaft that is parallel to and that is rotatable with the screw rods. Upper and lower driven gears are mounted on the gear mounting seat and are capable of selective engagement with a drive gear on a drive axle of a motor-driven rotary cutter on the cutter carriage. The arrangement as such permits motor-driven height adjustment of the cutter carriage.

9 Claims, 10 Drawing Sheets

SCANNED, #____

WOOD PLANING MACHINE THAT PERMITS MOTOR-DRIVEN HEIGHT ADJUSTMENT OF A CUTTER CARRIAGE

CROSS-REFERENCE TO RELATED APPLICATION

This application is a continuation-in-part of co-pending U.S. patent application Ser. No. 09/741,553, filed by the applicanton Dec. 19, 2000, the entire disclosure of which is incorporated herein by reference.

BACKGROUND OF THE INVENTION

1. Field of the Invention

The invention relates to a wood planing machine, more particularly to one that permits motor-driven height adjustment of a cutter carriage on the wood planing machine.

2. Description of the Related Art

U.S. Pat. No. 5,771,949 discloses a wood planing machine having a carriage locking mechanism for positioning a cutter carriage at an adjusted height relative to a machine base. However, it is noted that the locking mechanism has a relatively complex construction, and assembly thereof is laborious. Moreover, there is a tendency for the locking mechanism to experience elastic fatigue after a period of use, which can cause undesirable problems, such as loosening and vibration of the cutter carriage during operation of the wood planing machine.

In co-pending U.S. patent application Ser. No. 09/741,553, the applicant disclosed a wood planing machine that includes a base, two pairs of parallel hollow posts, two pairs of parallel screw rods, four sprockets, a chain, a cutter carriage, and four threaded members. The hollow posts extend upright from the opposite sides of the base, and are respectively formed with elongated slots that extend along lengths of the posts. The screw rods are disposed respectively in the posts, and are rotatable about axes defined by the screw rods. Each of the screw rods has a portion that is accessible via the slot in the respective one of the posts. The sprockets are connected respectively to the screw rods, and the chain engages the sprockets so as to synchronize rotations of the screw rods. The cutter carriage carries a motor-driven rotary cutter, and includes a pair of parallel carriage seats mounted movably and respectively on the pairs of the posts. Each carriage seat includes top and bottom plates transverse to and spanning a respective pair of the posts, and two opposite side plates interconnecting the top and bottom plates and formed with openings that are registered with the slots in the posts. The threaded members are mounted respectively on the side plates of the carriage seats. Each threaded member includes a bracket plate mounted on the respective side plate, and a sector-shaped threaded portion projecting from the bracket plate through the opening in the respective side plate to engage threadedly a respective screw rod. As such, when a handle that is coupled to one of the screw rods is operated to rotate the screw rods synchronously, the carriage seats can move simultaneously along the posts, and can be held firmly at a desired height relative to the base upon stopping rotation of the screw rods. Planing of a wooden work piece can be conducted at this time.

It is desirable to improve the wood planing machine of the aforesaid co-pending U.S. patent application to permit motor-driven height adjustment of the cutter carriage for added convenience.

SUMMARY OF THE INVENTION

Therefore, the main object of the present invention is to provide a wood planing machine that permits motor-driven height adjustment of a cutter carriage on the wood planing machine.

Another object of the present invention is to provide a wood planing machine that further permits manual height adjustment of the cutter carriage.

According to the present invention, a wood planing machine comprises:

- a base having two opposite sides;
- two pairs of parallel hollow posts that extend upright from the opposite sides of the base, and that are respectively formed with elongated slots extending along lengths of the posts;
- two pairs of parallel screw rods disposed respectively in the posts, and rotatable about axes defined by the screw rods, each of the screw rods having a portion that is accessible via the slot in the respective one of the posts;
- four first sprockets connected respectively to the screw rods;
- a chain engaging the first sprockets so as to synchronize rotations of the screw rods;
- a cutter carriage including first and second carriage seats mounted movably and respectively on the pairs of the posts, each of the carriage seats includes top and bottom plates transverse to and spanning the respective pair of the posts, and two opposite side plates interconnecting the top and bottom plates and formed with openings that are registered with the slots in the posts;
- four threaded members mounted respectively on the side plates of the carriage seats, each of the threaded members including a bracket plate mounted on the respective one of the side plates, and a sector-shaped threaded portion projecting from the bracket plate through the opening in the respective one of the side plates to engage threadedly a respective one of the screw rods so as to permit the carriage seats to move simultaneously along the posts when the screw rods rotate synchronously, and to be held firmly at a desired height relative to the base upon stopping rotation of the screw rods;
- a drive shaft disposed rotatably on the base parallel to the screw rods and adjacent to the first carriage seat;
- a second sprocket connected to the drive shaft and engaging the chain such that rotation of the drive shaft can result in corresponding rotation of the screw rods;
- a motor-driven rotary cutter mounted on the cutter carriage and having a rotatable drive axle that extends into the first carriage seat between the top and bottom plates and between the side plates of the first carriage seat;
- a drive gear mounted securely and co-axially on the drive axle so as to be rotatable therewith;
- a gear mounting seat having upper and lower plate portions and abridging plate portion that interconnects the upper and lower plate portions;
- an upper driven gear mounted rotatably on the upper plate portion of the gear mounting seat, and sleeved slidably on and rotatable with the drive shaft; and
- a lower driven gear mounted rotatably on the lower plate portion of the gear mounting seat, and sleeved slidably on and rotatable with the drive shaft.

The gear mounting seat is movable along the drive shaft relative to the first carriage seat to a selected one of an intermediate first position, where the upper and lower driven gears disengage the drive gear, an upper second position, where the upper driven gear disengages and the lower driven gear engages the drive gear, and a lower third position, where the lower driven gear disengages and the upper driven gear engages the drive gear.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
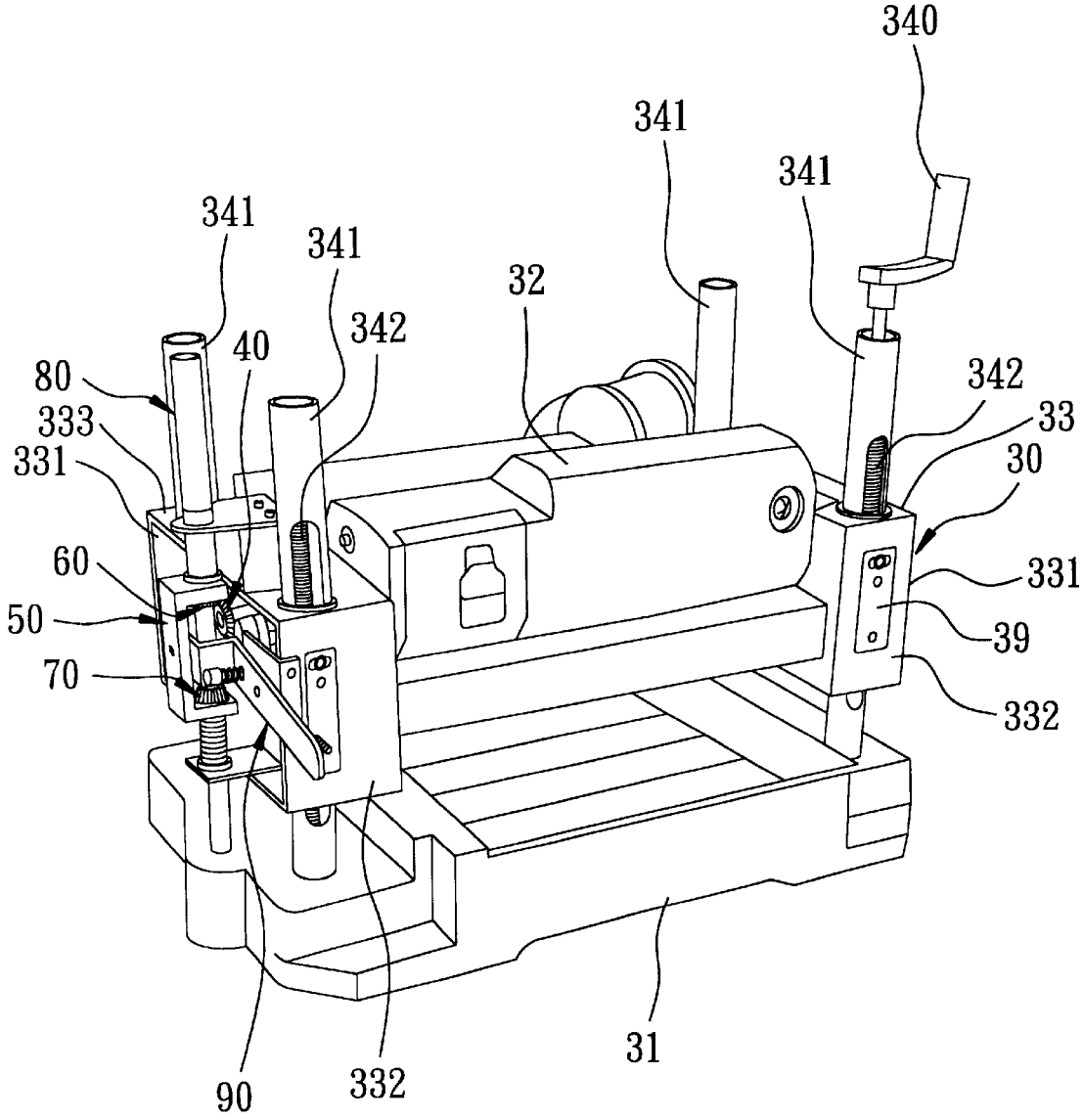
FIG. 1 is a perspective view of the preferred embodiment of a wood planing machine according to the present invention.
Figure 2:
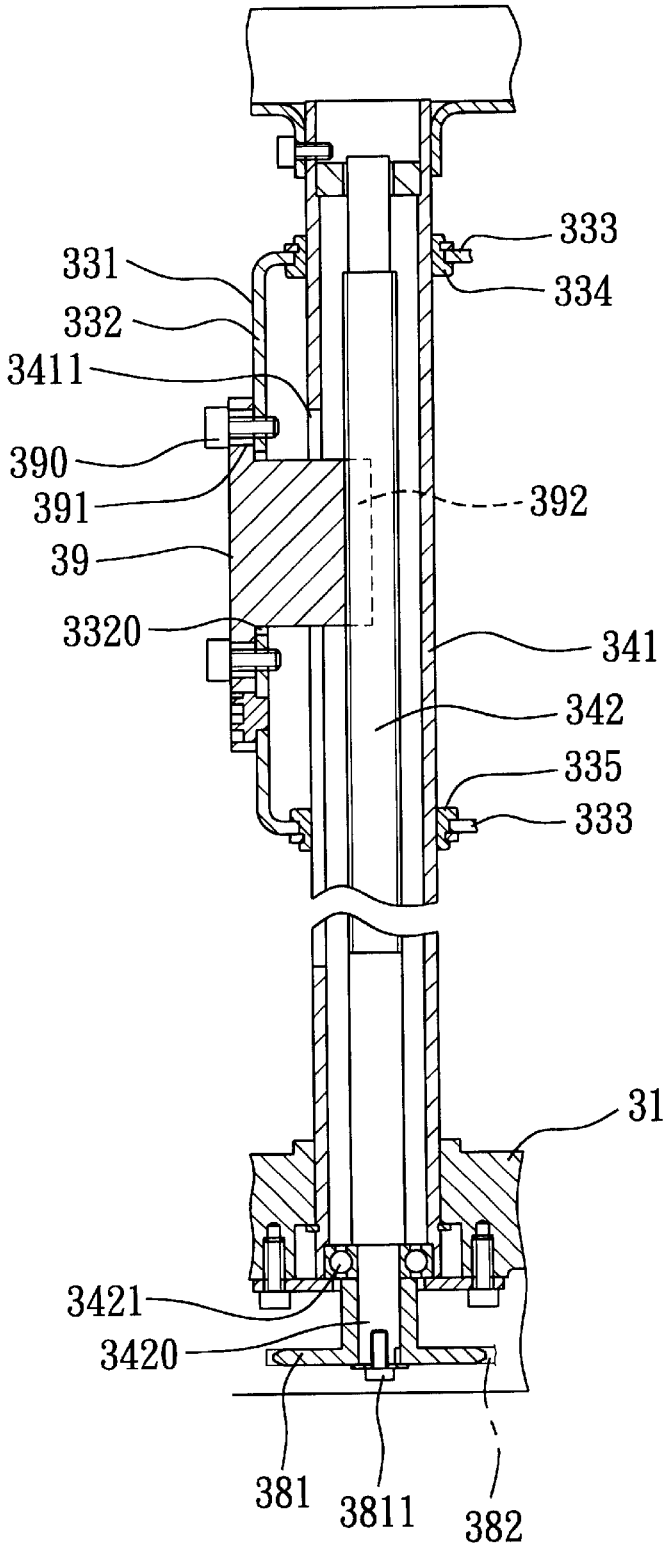
FIG. 2 is a fragmentary cross-sectional view to illustrate how a cutter carriage of the preferred embodiment is retained at a desired height.
Figure 3:
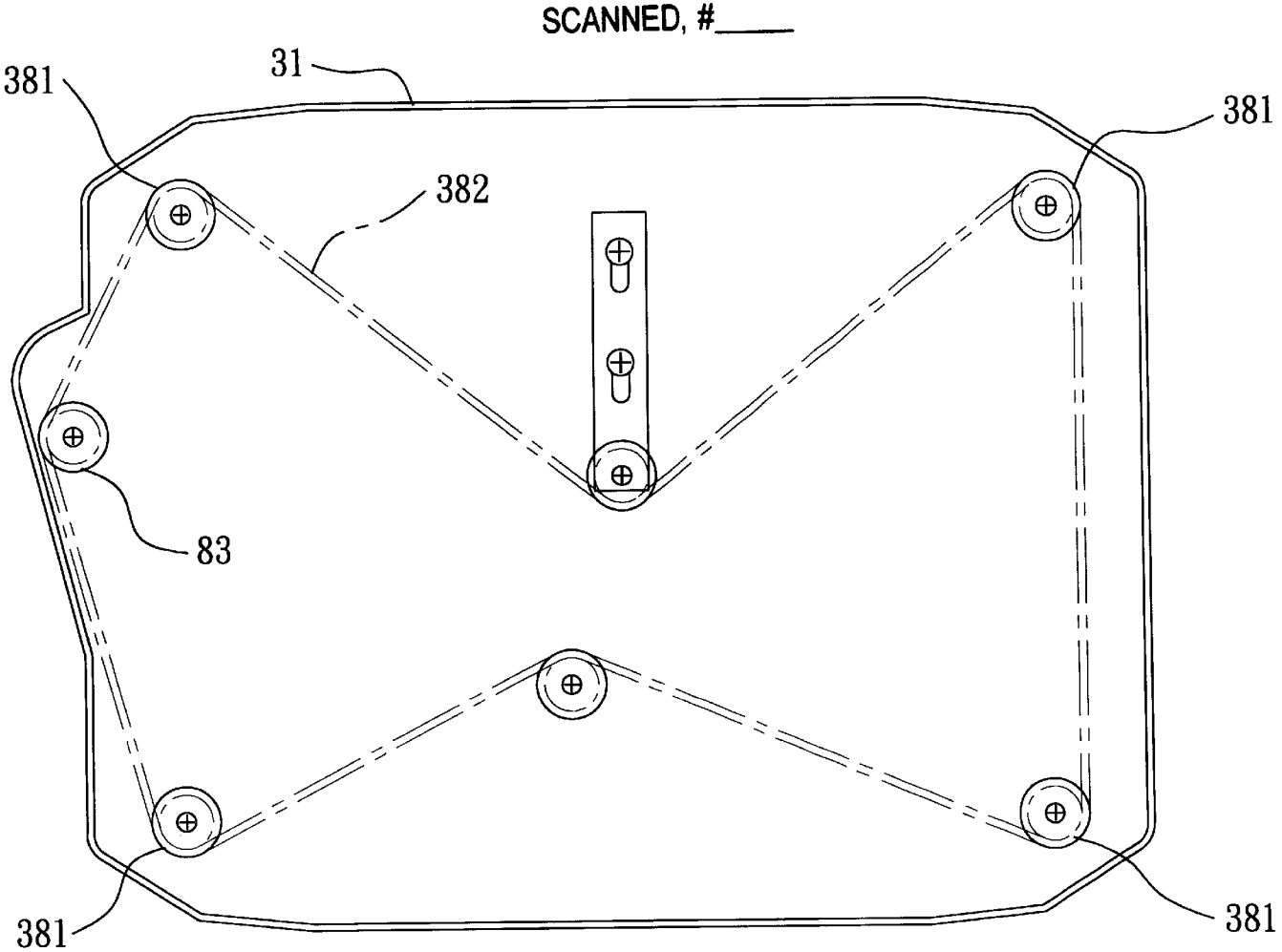
FIG. 3 is a bottom view of the preferred embodiment.

FIG. 1 illustrates a wood planing machine 30 that embodies the present invention. With further reference to FIGS. 2 and 3, like the wood planing machine described in the aforesaid co-pending U.S. patent application, the machine 30 of this invention includes a base 31, two pairs of parallel hollow posts 341, two pairs of parallel screw rods 342, four first sprockets 381, a chain 382, a cutter carriage 33, and four threaded members 39. The hollow posts 341 extend upright from two opposite sides of the base 31, and are respectively formed with elongated slots 3411 that extend along lengths of the posts 341. The screw rods 342 are disposed respectively in the posts 341. Each of the screw rods 342 has a lower end portion 3420 coupled to the respective post 341 by means of a bearing 3421 so as to be rotatable about an axis defined by the screw rod 342. Each of the screw rods 342 further has a portion that is accessible via the slot 3411 in the respective post 341. The first sprockets 381 are disposed beneath the base 31 and are connected respectively to the lower end portions 3420 of the screw rods 342 by means of screw fasteners 3811 such that the sprockets 381 are co-rotatable with the screw rods 342. The chain 382 engages the first sprockets 381 so as to synchronize rotations of the screw rods 342. A handle 340 is connected to a top end of one of the screw rods 342 so as to drive rotation of the screw rods 342 manually. The cutter carriage 33 includes first and second carriage seats 331 mounted movably and respectively on the pairs of the posts 341. Each carriage seat 331 includes top and bottom plates 333 transverse to and spanning a respective pair of the posts 341, and two opposite side plates 332 interconnecting the top and bottom plates 333 and formed with openings 3320 that are registered with the slots 3411 in the posts 341. The posts 341 and the screw rods 342 extend through the top and bottom plates 333. Two pairs of upper sleeves 334 are secured to the top plates 333 and are sleeved on the posts 341. Two pairs of lower sleeves 335 are secured to the bottom plates 333 and are sleeved on the posts 341. A motor-driven rotary cutter 32 is mounted on the cutter carriage 33 between the carriage seats 331. The rotary cutter 32 includes a motor (not shown) a cutter (not shown) driven rotatably by the motor, a rotatable drive axle 321 and a speed-reduction gear box (not shown) that couples the motor to the drive axle 321 for driving rotation of the latter. The rotary cutter 32 is operable for planing a wooden work piece (not shown) on the base 31. The drive axle 321 extends into the first carriage seat 331 between the top and bottom plates 333 and between the side plates 332 of the first carriage seat 331, and is coupled to guide rollers 35, 36 on the cutter carriage 33 by means of pulleys 43, 35 and a chain unit 351 for guiding movement of the work piece (not shown) on the base 31.

The threaded members 39 are mounted respectively on the side plates 332 of the carriage seats 331. Each threaded member 39 includes a bracket plate 391 mounted on the respective side plate 332 by means of screw fasteners 390, and a sector-shaped threaded portion 392 projecting from the bracket plate 391 through the opening 3320 in the respective side plate 332 to engage threadedly a respective screw rod 342. As such, when the handle 340 is operated to rotate the screw rods 342 synchronously, the carriage seats 331 can move simultaneously along the posts 341, and can be held firmly at a desired height relative to the base 31 by the engagement between the screw rods 342 and the threaded members 39 upon stopping rotation of the screw rods 342.

In the machine 30 of this invention, in order to permit motor-driven height adjustment of the cutter carriage 33, the machine 30 further comprises a drive shaft 80, a second sprocket 83, a drive gear 40, a gear mounting seat 50, upper and lower driven gears 60, 70, and a switching unit 90.

The drive shaft 80 is disposed rotatably on the base 31 parallel to the screw rods 342 and adjacent to the first carriage seat 331. The drive shaft 80 is formed with an axially extending keyway 81, and has a lower end portion 82 mounted with the second sprocket 83. Like the screw rods 342, the lower end portion 82 of the drive shaft 80 extends rotatably through the base 31, and the second sprocket 83 engages the chain 381 such that rotation of the drive shaft 80 can result in synchronous rotation of the screw rods 342.

Figure 4:
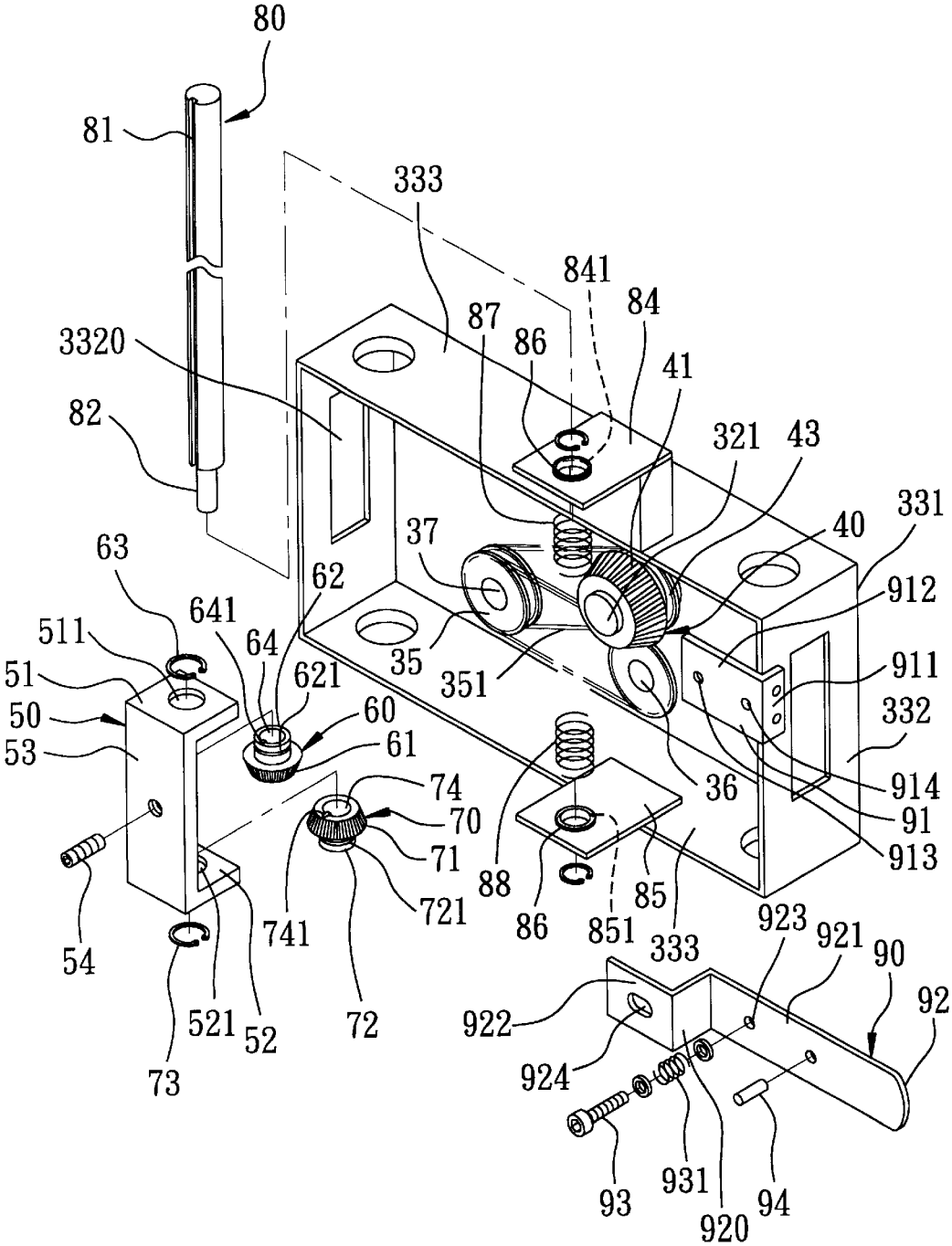
FIG. 4 is a fragmentary exploded perspective view illustrating components of the preferred embodiment that enable motor-driven height adjustment of the cutter carriage.
Figure 5:
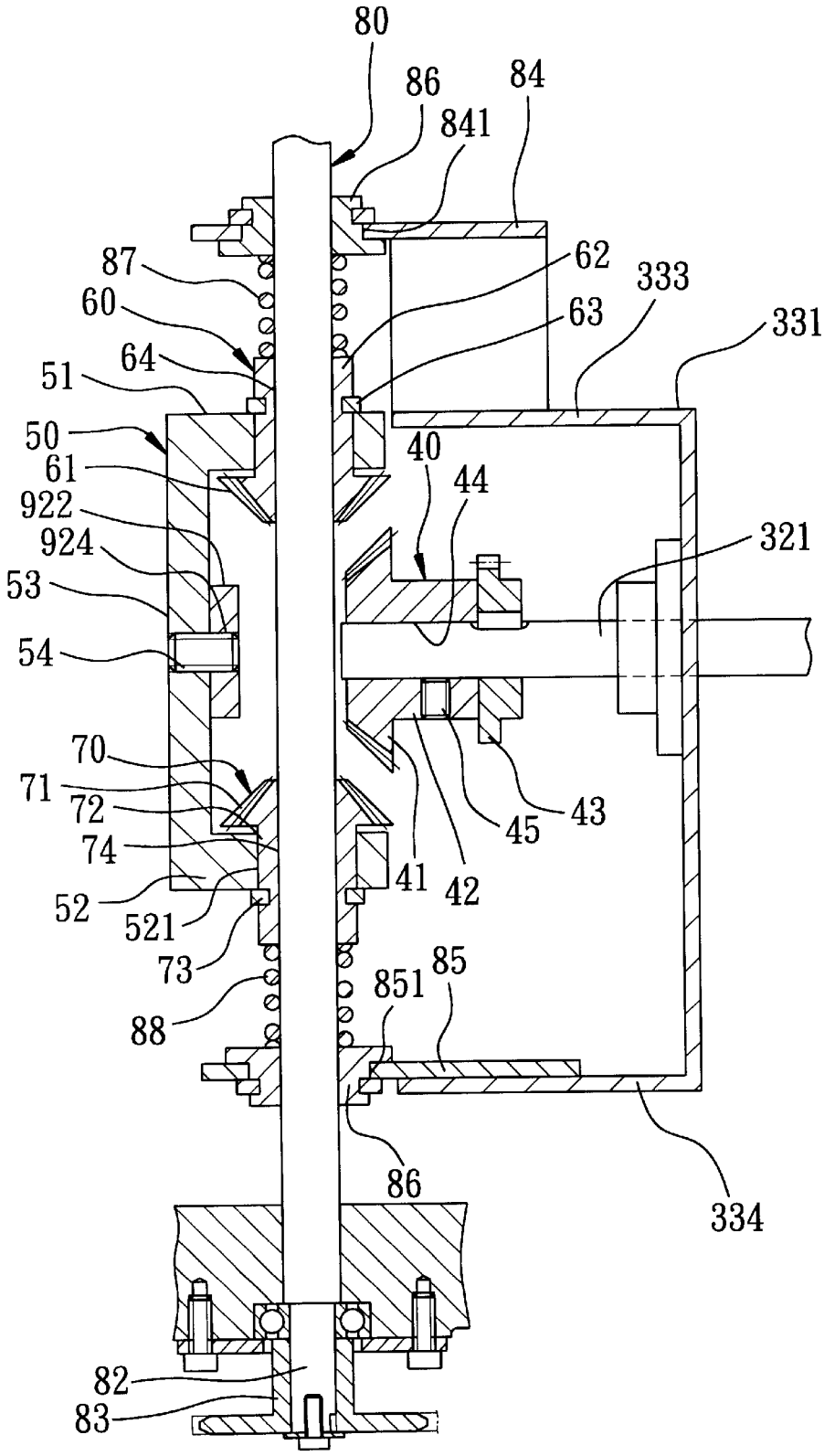
FIG. 5 is another fragmentary cross-sectional view, illustrating the preferred embodiment when a gear mounting seat thereof is disposed at an intermediate first position.

With further reference to FIGS. 4 and 5, the drive gear 40 includes a gear portion 41, in the form of a bevel gear, and a sleeve portion 42 extending from the gear portion 41. The drive gear 40 is formed with an axial hole 44 to permit sleeving of the drive gear 40 on the drive axle 321 of the rotary cutter 32. A lock fastener 45 extends radially through the sleeve portion 42 so as to engage the drive axle 321. As such, the drive gear 40 is mounted securely and co-axially on the drive axle 321 and is capable of rotating with the drive axle 321.

The gear mounting seat 50 includes an upper plate portion 51, a lower plate portion 52 and a bridging plate portion 53 that interconnects the upper and lower plate portions 51, 52. The upper and lower plate portions 51, 52 are formed with aligned shaft holes 511, 521. The bridging plate portion 53 is formed with a screw hole for engaging a threaded shank 54. One end of the threaded shank 54 projects from an inner wall surface of the bridging plate portion 53 to serve as a retaining stud.

The upper driven gear 60 includes a gear portion 61, in the form of a bevel gear, for meshing with the gear portion 41 of the drive gear 40, and a sleeve portion 62 extending from the gear portion 61. The sleeve portion 62 extends into the shaft hole 511 in the upper plate portion 51 of the gear mounting seat 50, and has an outer wall surface formed with an annular groove 621 for engaging a fastening ring 63, thereby retaining the upper driven gear 60 rotatably on the upper plate portion 51 of the gear mounting seat 50. The upper driven gear 60 is formed with an axial hole 64. The axial hole 64 has a hole-defining surface that is formed with a radial inward key projection 641.

The lower driven gear 70 includes a gear portion 71, in the form of a bevel gear, for meshing with the gear portion 41 of the drive gear 40, and a sleeve portion 72 extending from the gear portion 71. The sleeve portion 72 extends into the shaft hole 521 in the lower plate portion 52 of the gear mounting seat 50, and has an outer wall surface formed with an annular groove 721 for engaging a fastening ring 73, thereby retaining the lower driven gear 70 rotatably on the lower plate portion 52 of the gear mounting seat 50. The lower driven gear 70 is formed with an axial hole 74. The axial hole 74 has a hole-defining surface that is formed with a radial inward key projection 741.

When the drive shaft 80 is extended through the axial holes 64, 74 in the upper and lower driven gears 60, 70, the key projections 641, 741 will engage the keyway 81 slidably, thereby enabling the drive shaft 80 to rotate synchronously with the driven gears 60, 70. The gear mounting seat 50 is movable along the drive shaft 80 relative to the first carriage seat 331 to a selected one of an intermediate first position, where the upper and lower driven gears 60, 70 disengage the drive gear 40 (see FIG. 5), an upper second position, where the upper driven gear 60 disengages and the lower driven gear 70 engages the drive gear 40 (see FIG. 11), and a lower third position, where the lower driven gear 70 disengages and the upper driven gear 60 engages the drive gear 40 (see FIG. 12).

To stabilize rotation of the drive shaft 80, the top plate 333 of the first carriage seat 331 is formed with an upper positioning seat 84, whereas the bottom plate 333 of the first carriage seat 331 is formed with a lower positioning seat 85. The upper and lower positioning seats 84, 85 are formed with aligned shaft holes 841, 851 that permit the drive shaft 80 to extend rotatably therethrough. Each of the shaft holes 841, 851 has an annular lining member 86 disposed therein for contacting the drive shaft 80.

An upper coil spring 87 is sleeved on the drive shaft 80 and is disposed between the upper positioning seat 84 and the upper plate portion 51 of the gear mounting seat 50. In this embodiment, the upper coil spring 87 has opposite ends that abut against the lining member 86 on the upper positioning seat 84 and the sleeve portion 62 of the upper driven gear 60 on the upper plate portion 51 of the gear mounting seat. A lower coil spring 88 is sleeved on the drive shaft 80 and is disposed between the lower positioning seat 85 and the lower plate portion 52 of the gear mounting seat 50. In this embodiment, the lower coil spring 88 has opposite ends that abut against the lining member 86 on the lower positioning seat 85 and the sleeve portion 72 of the lower driven gear 70 on the lower plate portion 52 of the gear mounting seat 50.

Figure 6:
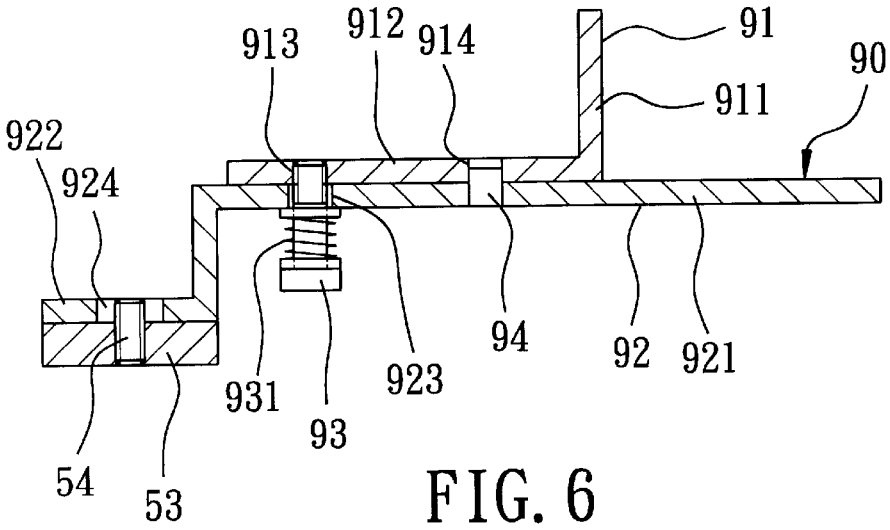
FIG. 6 is a sectional view illustrating a switching unit of the preferred embodiment.

With further reference to FIG. 6, the switching unit 90 includes a lever mounting seat 91, an actuating lever 92, and a fastener 93. The lever mounting seat 91 is generally L-shaped, and has amounting endportion 911 secured to one of the side plates 332 of the first carriage seat 331, and a lever supporting portion 912 that extends transverse to the mounting end portion 911 and that is formed with a locking hole 913 and a pin hole 914 that are aligned along a longitudinal axis of the lever supporting portion 912.

The actuating lever 92 has an actuating portion 921 that extends parallel to the lever supporting portion 912, a connecting plate portion 920 that extends transversely from one end of the actuating portion 921 in a direction away from the first carriage seat 331, and a coupling portion 922 that extends from one end of the connecting plate portion 920 and that is parallel to the actuating portion 921. The actuating portion 921 is formed with a through hole 923 to be aligned with the locking hole 913. The actuating portion 921 is provided with a pin 94 having one end secured thereto, and an opposite end to be inserted removably into the pin hole 914 for retaining releasably the gear mounting seat 50 at the first position. The coupling portion 922 is formed with an elongate slot 924. The threaded shank 54 on the bridging plate portion 53 of the gear mounting seat 50 extends into the elongate slot 924. The slot 924 has a width corresponding to the diameter of the threaded shank 54 such that the latter is slidable along the slot 924.

In this embodiment, the fastener 93 is a screw fastener that extends through the through hole 923 and that engages the locking hole 913. The actuating portion 921 of the actuating lever 92 is slidable along the fastener 93. When the pin 94 is disengaged from the pin hole 914, the actuating lever 92 can be pivoted relative to the lever mounting seat 91 about an axis parallel to the drive axle 321 for moving the gear mounting seat 50 to the selected one of the first, second and third positions. A biasing member 931, in the form of a coil spring, is sleeved on the fastener 93 and is disposed between a headed end of the fastener 93 and the actuating portion 921 of the actuating lever 92 for biasing the latter toward the lever supporting portion 912 of the lever mounting seat 91 so as to arrest undesired removal of the pin 94 from the pin hole 914.

Figure 8:
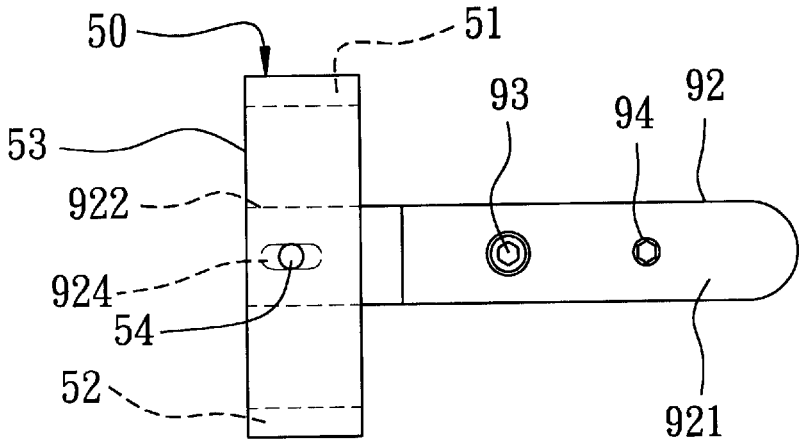
FIG. 8 is a schematic view to illustrate the relationship between the switching unit and the gear mounting seat when the latter is disposed at the intermediate first position.

In use, during a wood planing operation, the gear mounting seat 50 is disposed in the intermediate first position such that the drive gear 40 does not mesh with either of the upper and lower driven gears 60, 70, as best shown in FIG. 5. With further reference to FIGS. 6 and 8, because the pin 94 engages the pin hole 914, pivoting movement of the actuating lever 92 relative to the lever mounting seat 91 is arrested to retain the gear mounting seat 50 at the first position. The actuating portion 921 of the actuating lever 92 is generally parallel to the upper and lower plate portions 51, 52 of the gear mounting seat 50 at this time.

Figure 7:
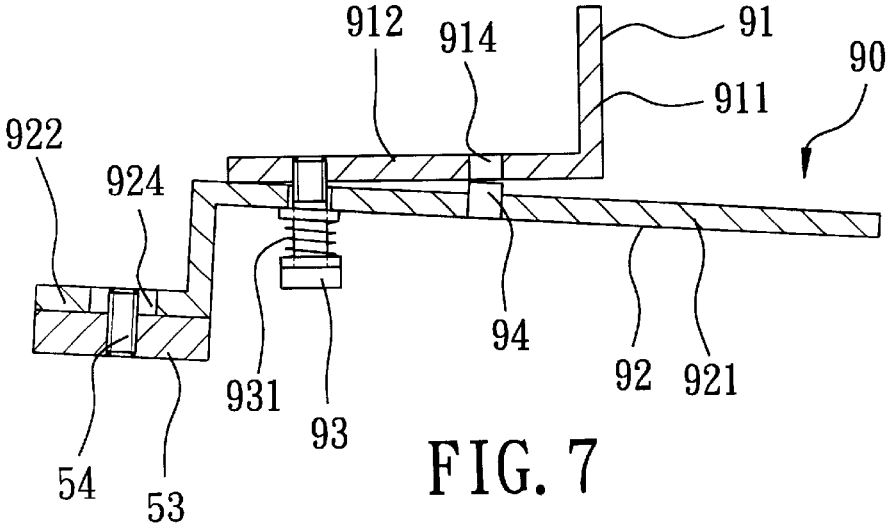
FIG. 7 is another sectional view illustrating how the switching unit of the preferred embodiment is operated.
Figure 9:
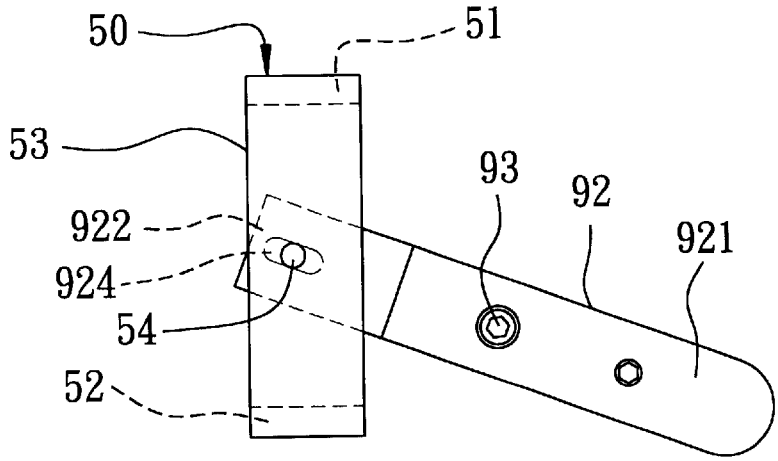
FIG. 9 is a schematic view to illustrate the relationship between the switching unit and the gear mounting seat when the latter is disposed at an upper second position.
Figure 11:
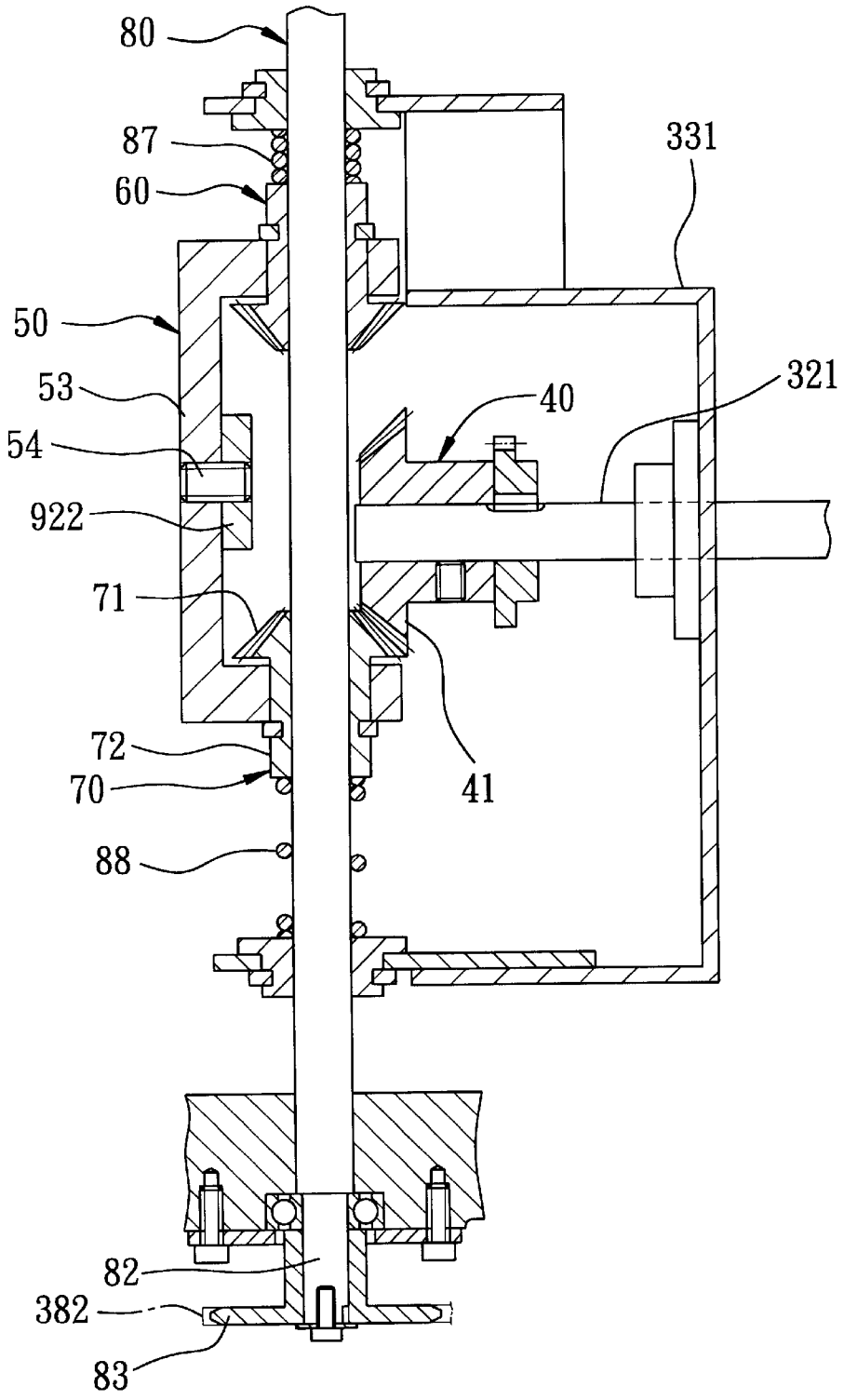
FIG. 11 is a fragmentary cross-sectional view similar to FIG. 5, illustrating the preferred embodiment when the gear mounting seat is disposed at the upper second position.

Referring to FIGS. 7, 9 and 11, when it is desired to lower the cutter carriage 33, the actuating lever 92 is operated to remove the pin 94 from the pin hole 914. Then, by pressing the actuating portion 921 of the actuating lever 92 downward, the actuating lever 92 will pivot about the fastener 93 to move the coupling portion 922 upwardly. Due to the pin-and-slot engagement between the coupling portion 922 and the gear mounting seat 50, the gear mounting seat 50 will also move upwardly at this time to dispose the same in the upper second position, where the upper driven gear 60 disengages and the lower driven gear 70 engages the drive gear 40 (see FIG. 11). Thus, rotation of the drive axle 321 will be transmitted to the drive shaft 80 via the drive gear 40 and the lower driven gear 70. Rotation of the drive shaft 80 will then result in synchronous rotation of the screw rods 342 by virtue of the first and second sprockets 381, 83 and the chain 382, thus lowering the cutter carriage 33 toward the base 31.

Figure 10:
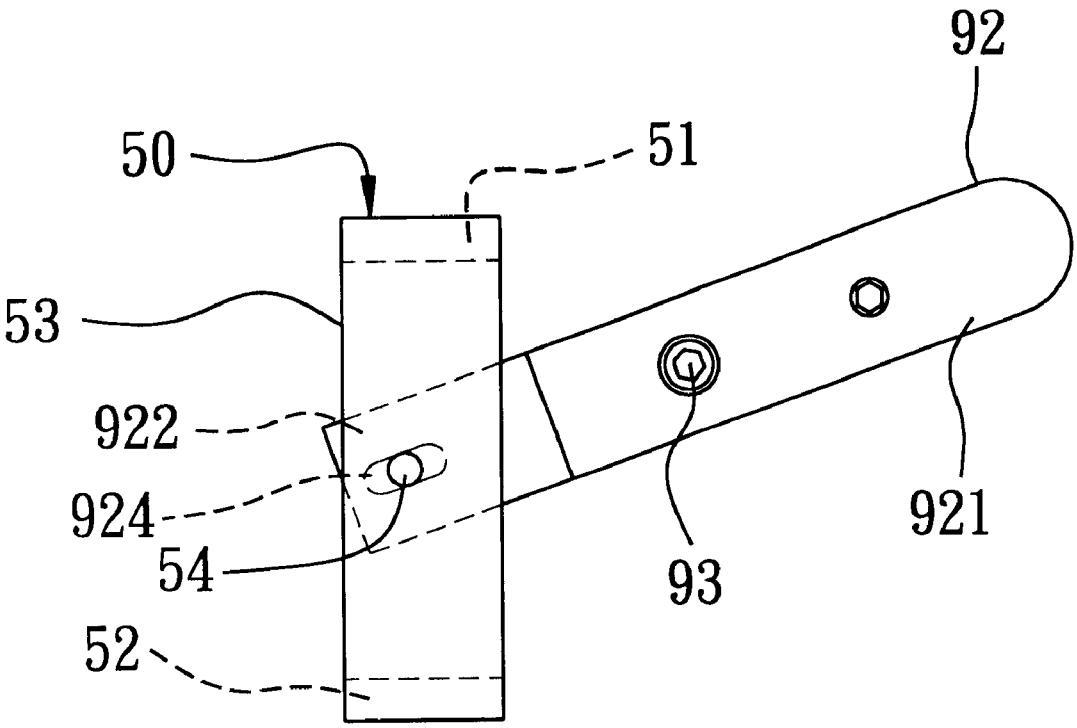
FIG. 10 is a schematic view to illustrate the relationship between the switching unit and the gear mounting seat when the latter is disposed at a lower third position.
Figure 12:
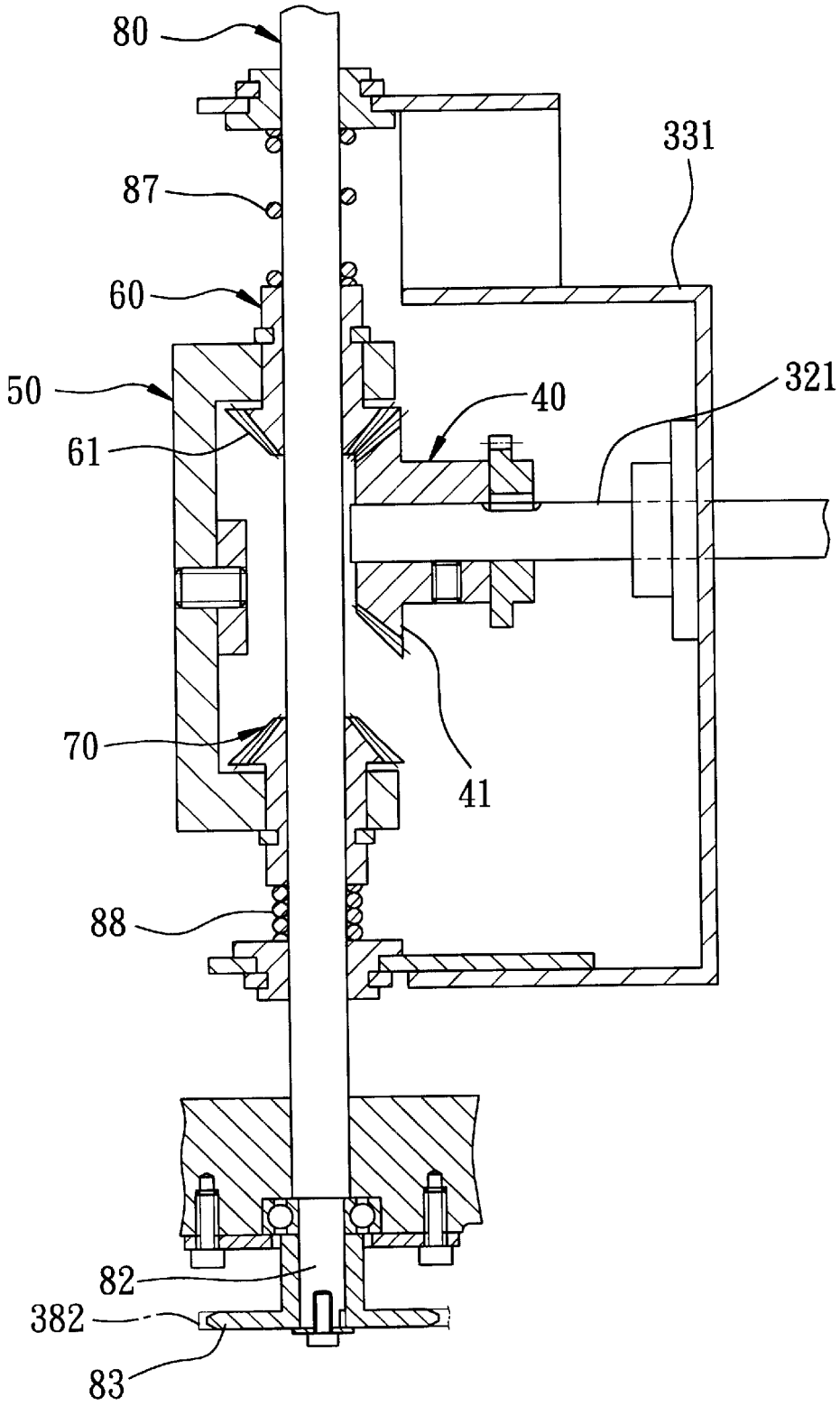
FIG. 12 is a fragmentary cross-sectional view similar to FIG. 5, illustrating the preferred embodiment when the gear mounting seat is disposed at the lower third position.

Referring to FIGS. 7, 10 and 12, when it is desired to raise the cutter carriage 33, after operating the actuating lever 92 to remove the pin 94 from the pin hole 914, the actuating portion 921 of the actuating lever 92 is pushed upward such that the actuating lever 92 will pivot about the fastener 93 to move the coupling portion 922 downward. Due to the pin-and-slot engagement between the coupling portion 922 and the gear mounting seat 50, the gear mounting seat 50 will also move downwardly at this time to dispose the same in the lower third position, where the lower driven gear 70 disengages and the upper driven gear 60 engages the drive gear 40 (see FIG. 12). Thus, rotation of the drive axle 321 will be transmitted to the drive shaft 80 via the drive gear 40 and the upper driven gear 60. Rotation of the drive shaft 80 will then result in synchronous rotation of the screw rods 342 by virtue of the first and second sprockets 381, 83 and the chain 382, thus raising the cutter carriage 33 away from the base 31.

It has thus been shown that the wood planing machine 30 of this invention permits motor-driven height adjustment of the cutter carriage 33 thereof for added convenience. In addition, due to the handle 340 on the top end of one of the screw rods 342, manual height adjustment of the cutter carriage 33 is still possible. The objects of the invention are thus met.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A wood planing machine comprising:

a base having two opposite sides;

two pairs of parallel hollow posts that extend upright from said opposite sides of said base, and that are respectively formed with elongated slots extending along lengths of said posts;

two pairs of parallel screw rods disposed respectively in said posts, and rotatable about axes defined by said screw rods, each of said screw rod shaving a portion that is accessible via said slot in the respective one of said posts;

four first sprockets connected respectively to said screw rods;

a chain engaging said first sprockets so as to synchronize rotations of said screw rods;

a cutter carriage including first and second carriage seats mounted movably and respectively on said pairs of said posts, each of said carriage seats includes top and bottom plates transverse to and spanning the respective pair of said posts, and two opposite side plates interconnecting said top and bottom plates and formed with openings that are registered with said slots in said posts;

four threaded members mounted respectively on said side plates of said carriage seats, each of said threaded members including a bracket plate mounted on the respective one of said side plates, and a sector-shaped threaded portion projecting from said bracket plate through said opening in the respective one of said side plates to engage threadedly a respective one of said screw rods so as to permit said carriage seats to move simultaneously along said posts when said screw rods rotate synchronously, and to be held firmly at a desired height relative to said base upon stopping rotation of said screw rods;

a drive shaft disposed rotatably on said base parallel to said screw rods and adjacent to said first carriage seat;

a second sprocket connected to said drive shaft and engaging said chain such that rotation of said drive shaft can result in synchronous rotation of said screw rods;

a motor-driven rotary cutter mounted on said cutter carriage and having a rotatable drive axle that extends into said first carriage seat between said top and bottom plates and between said side plates of said first carriage seat;

a drive gear mounted securely and co-axially on said drive axle so as to be rotatable therewith;

a gear mounting seat having upper and lower plate portions and a bridging plate portion that interconnects said upper and lower plate portions;

an upper driven gear mounted rotatably on said upper plate portion of said gear mounting seat, and sleeved slidably on and rotatable with said drive shaft; and a lower driven gear mounted rotatably on said lower plate portion of said gear mounting seat, and sleeved slidably on and rotatable with said drive shaft;

said gear mounting seat being movable along said drive shaft relative to said first carriage seat to a selected one of an intermediate first position, where said upper and lower driven gears disengage said drive gear, an upper second position, where said upper driven gear disengages and said lower driven gear engages said drive gear, and a lower third position, where said lower driven gear disengages and said upper driven gear engages said drive gear.

2. The wood planing machine of claim 1, further comprising:

a lever mounting seat secured to said first carriage seat;

an actuating lever having a coupling portion coupled to said gear mounting seat, and an actuating portion opposite to said coupling portion; and a fastener extending through said actuating portion of said actuating lever and secured to said lever mounting seat, said fastener permitting pivoting movement of said actuating lever relative to said lever mounting seat about an axis parallel to said drive axle for moving said gear mounting seat to the selected one of the first, second and third positions.

3. The wood planing machine of claim 2, wherein said actuating portion of said actuating lever is slidable along said fastener, said lever mounting seat being formed with a pin hole, said actuating portion of said actuating lever being provided with a pin that is inserted removably into said pin hole for retaining releasably said gear mounting seat at the first position.

4. The wood planing machine of claim 3, further comprising a biasing member for biasing said actuating portion of said actuating lever toward said lever mounting seat.

5. The wood planing machine of claim 1, wherein said top and bottom plates of said first carriage seat are respectively formed with upper and lower positioning seats having aligned shaft holes that permit said drive shaft to extend rotatably therethrough.

6. The wood planing machine of claim 5, further comprising an upper coil spring sleeved on said drive shaft and disposed between said upper positioning seat and said upper plate portion of said gear mounting seat, and a lower coil spring sleeved on said drive shaft and disposed between said lower positioning seat and said lower plate portion of said gear mounting seat.

7. The wood planing machine of claim 1, wherein said drive shaft is formed with an axially extending keyway, each of said upper and lower driven gears being formed with a radial inward key projection that extends slidably into said keyway.

8. The wood planing machine of claim 1, wherein each of said drive gear and said upper and lower driven gears is formed as a bevel gear.

9. The wood planing machine of claim 1, wherein said coupling portion of said actuating lever is formed with an elongate slot, said bridging plate portion of said gear mounting seat having an inner wall surface provided with a retaining stud that extends into and that is slidable along said elongated slot.

* * * * *